United States Patent [19]

Robertson et al.

[11] 4,382,750

[45] May 10, 1983

[54] HIGH PRESSURE FLUID PUMP

[75] Inventors: Walter W. Robertson; Walter W. Robertson, Jr., both of Cranesville, Pa.

[73] Assignee: Hydro-Pac, Inc., Fairview, Pa.

[21] Appl. No.: 219,256

[22] Filed: Dec. 22, 1980

[51] Int. Cl.[3] ..... F04B 35/00

[52] U.S. Cl. ..... 417/397; 92/129

[58] Field of Search ..... 92/128, 129; 417/397, 417/454, 349, 399

[56] References Cited

U.S. PATENT DOCUMENTS

| | | | |
|---|---|---|---|
| 1,081,784 | 12/1913 | Spohrer | 417/397 X |
| 1,372,391 | 3/1921 | Barner | 417/397 X |
| 1,729,430 | 9/1929 | Machtolf | 417/397 X |
| 2,216,573 | 10/1940 | Owsley | 92/128 |
| 2,991,003 | 7/1961 | Peterson | 417/397 X |
| 3,077,838 | 2/1963 | Maglott | 417/397 X |
| 3,771,912 | 11/1973 | Conlee | 417/397 |

*Primary Examiner*—Leonard E. Smith

*Attorney, Agent, or Firm*—Ralph Hammar

[57] ABSTRACT

A free piston compressor for gases and liquids in which the positive pressure of the incoming fluid holds the piston against the piston rod during the intake stroke. In a specific form, the cylinder head is a plug of larger diameter than the piston which can be unscrewed to permit removal and replacement of the piston for service.

6 Claims, 2 Drawing Figures

HIGH PRESSURE FLUID PUMP

This invention is a high pressure compressor for gas or liquid which is easy to service because the piston can be removed by merely removing the cylinder head.

In the drawing

Figure 1:
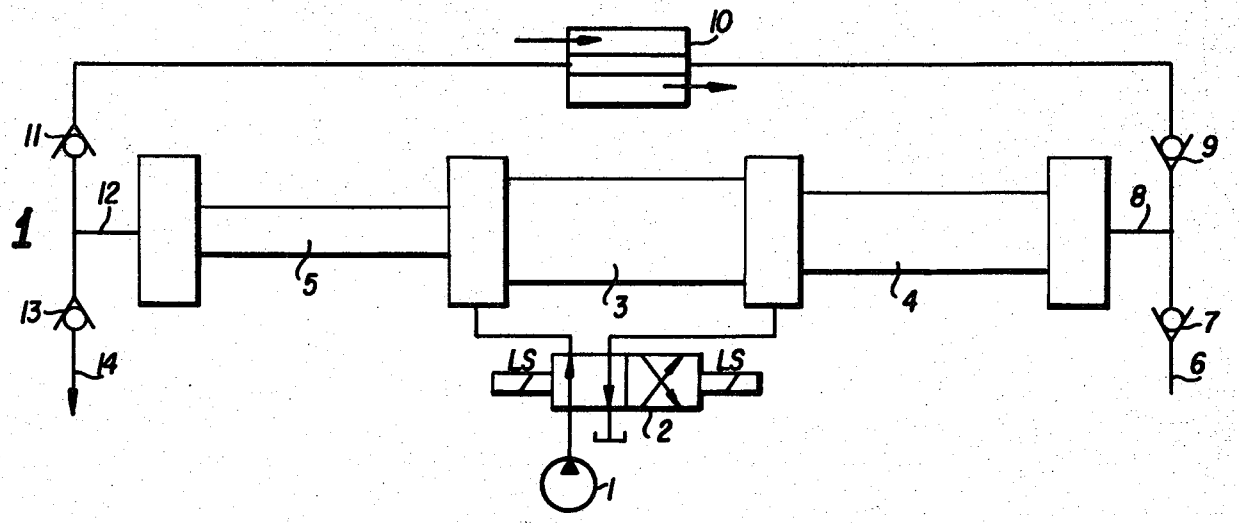
FIG. 1 is the diagrammatic view of a system using the compressor.

In FIG. 1 of the drawing the principle elements of the compressor consist of the source of hydraulic pressure 1, a valve and limit switch unit 2, hydraulic power unit 3, and first and second stage compression units 4 and 5. The incoming gas or liquid to be compressed enters from lines 6 through check valve 7 and common line 8. The high pressure fluid compressed in unit 4 leaves through common line 8 and check valve 9 and flows through intercooler 10, check valve 11 and common line 12 into unit 5. The fluid compressed in unit 5 leaves through common line 12 and check valve 13 and flows into high pressure line 14. The particular compressor shown is a two stage compressor having an incoming pressure in line 6 of 2,000 PSI and outlet pressure in line 14 of 30,000 PSI. These figures are by way of example and not of limitation. The compression in units 4 and 5 is preferably isothermal and to that end the units may be water jacketed (not shown).

Figure 2:
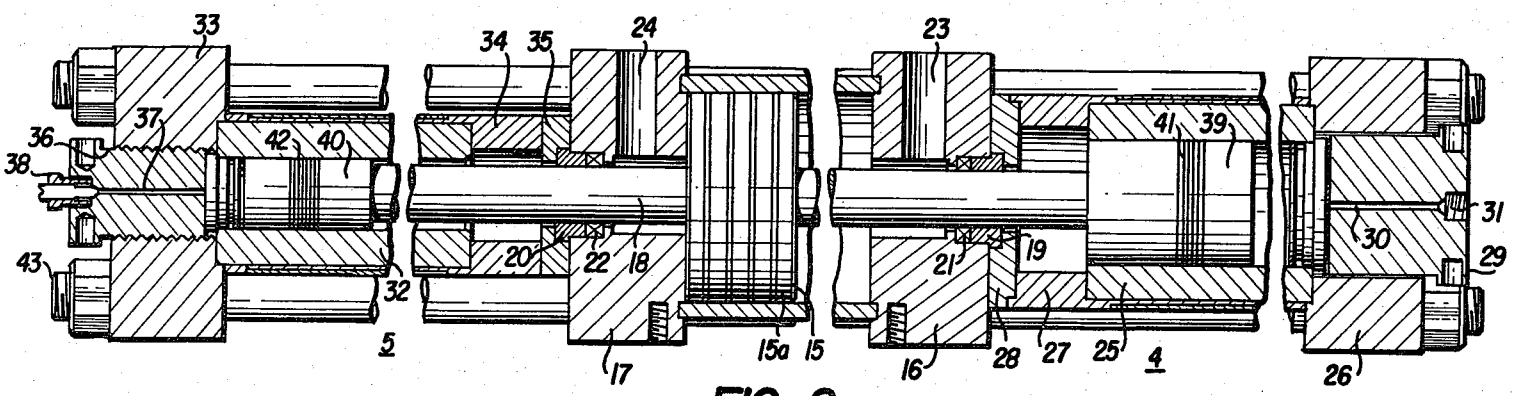
FIG. 2 is a fragmentary sectional view of the compressor.

Units 1 and 2 are of common construction. Unit 3 consists of a piston 15 in cylinder 15*a* clamped between cylinder flanges 16 and 17 respectively common to first and second stage units 4 and 5. The piston 15 is fixed to piston rod 18 guided in bushings 19 and 20. Leakage of hydraulic fluid around the rod 18 is prevented by packing 21 associated with bushing 19 and by packing 22 associated with bushing 20. In FIG. 2 the piston is shown at the end of the intake stroke for the first stage unit 4 which is also the end of the pressure stroke for the second stage unit 5. To move the piston toward the position illustrated, high pressure fluid is supplied through way 23 in cylinder flange 16 and the return fluid flows through way 24 in cylinder flange 17. To cause piston 15 to reverse or to move to the right from the position shown in FIG. 2 high pressure fluid is supplied through the way 24 and the return fluid flows through way 23. The control and timing of the supply of hydraulic fluid to the ways 23 and 24 is effected by the valves and limit switches of unit 2.

The first stage 4 comprises a cylinder 25 clamped between a common cylinder flange 16 and cylinder flange 26. A spacer ring 27 and retainer plate 28 are arranged between the cylinder 25 and the cylinder flange 16. In the cylinder flange 26 is an externally threaded cylinder head 29 with a center way 30 for both incoming and outgoing fluids. The outer end of the head is provided with a threaded opening 31 for a fitting for connecting way 30 to the common way 8.

The second stage unit 5 is of the same construction as the unit 4 but is of smaller diameter due to the higher pressure involved. It comprises a cylinder 32 clamped between cylinder flange 33 and common flange 17. An annular spacer 34 and a plate 35 are clamped between the cylinder 32 and the common flange 17. The cylinder head comprises a plug 36 screwed into the cylinder flange 33 and having a central way 37 receiving a fitting 38 for connecting the way 37 to the common way 12.

The units 4 and 5 have pistons 39, 40 which are free of any connection to the piston rod 18 and are accordingly compelled to follow the piston rod on its intake stroke by the pressure of the incoming fluid. If the incoming fluid pressure were zero, as would be the case if the incoming fluid pressure were shut off, the pistons 39 and 40 would not follow the piston rod 18 on its return stroke and would accordingly remain in the outermost positions adjacent the cylinder heads 29 and 36. By unscrewing the cylinder heads 29 and 36, the pistons may be easily removed and the packing 41, 42 replaced. When the piston packing 41, 42 is sufficiently worn so that replacement is necessary, it is not necessary to disturb the tie rods 43 which hold the compressor parts in assembled relation. It is only necessary to disconnect the common lines 8, 12 from the cylinder heads 29, 36 and remove the cylinder heads. All of the other structural and operating parts and fluid lines remain undisturbed.

The invention is adapted to single and multiple stage pumps or compressors for either liquids or gases and is not limited to the particular structure shown.

We claim:

1. A compressor comprising a cylinder having a head at one end and a seal at the other end, a piston rod having one end extending into the cylinder through said seal, means for reciprocating the rod toward and away from the head, a free piston in the cylinder not connected to the rod but in position to be engaged by the rod, a port through the head for fluid under pressure, and means for connecting said port to a fluid inlet under positive pressure when said piston rod is moving away from the head so the said pressure forces the piston to move with the piston rod as the cylinder is filled with said fluid and for connecting said port to a high pressure outlet when said piston rod is moving back toward said head.

2. The structure of claim 1 in which the head is mounted in a flange held against said one end of the cylinder by tie rods and the head is removable without disturbing the tie rods to open said one end of the cylinder for removal and replacement of said piston.

3. The structure of claim 1 in which the means for reciprocating the piston rod comprises a hydraulic piston engaging the other end of said rod and controlled by limit switches to reverse the travel.

4. The structure of claim 2 in which the cylinder head is a plug screwed into said flange.

5. The structure of claim 2 in which the head is mounted in a flange held against the cylinder and the head is removable without disturbing the flange.

6. The structure of claim 5 in which the head is a plug screwed into a flange.

* * * * *